US006336994B1

(12) United States Patent
Backlund et al.

(10) Patent No.: US 6,336,994 B1
(45) Date of Patent: Jan. 8, 2002

(54) TOTALLY CHLORINE FREE BLEACHING PROCESS USING RECOVERED FILTRATE

(75) Inventors: Åke Backlund, Karlstad; Bengt Nilsson, Skoghall; Lars Stigsson, Hammaro, all of (SE)

(73) Assignee: Kvaerner Pulping Aktiebolag, Karlstad (SE)

( * ) Notice: Subject to any disclaimer, the term of this patent is extended or adjusted under 35 U.S.C. 154(b) by 0 days.

(21) Appl. No.: 08/434,331

(22) Filed: May 2, 1995

Related U.S. Application Data

(63) Continuation of application No. 08/160,257, filed on Dec. 2, 1993, now abandoned.

(30) Foreign Application Priority Data

Dec. 2, 1992 (SE) ..... 9203612

(51) Int. Cl.[7] ..... D21C 9/147; D21C 9/153; D21C 9/16; D21C 11/04

(52) U.S. Cl. ..... 162/29; 162/30.1; 162/65; 162/76; 162/78

(58) Field of Search ..... 162/29, 30.1, 30.11, 162/76, 65, 78

(56) References Cited

U.S. PATENT DOCUMENTS

| | | | | |
|---|---|---|---|---|
| 3,725,194 A | * | 4/1973 | Smith et al. | 162/65 |
| 4,039,372 A | | 8/1977 | Reeve et al. | 162/19 |
| 4,372,812 A | | 2/1983 | Phillips et al. | 162/40 |
| 4,595,455 A | * | 6/1986 | Mannbro | 162/65 |
| 4,601,786 A | * | 7/1986 | Santen et al. | 162/30.1 |
| 5,164,043 A | | 11/1992 | Griggs et al. | 162/65 |
| 5,164,044 A | | 11/1992 | Griggs et al. | 162/65 |
| 5,340,440 A | * | 8/1994 | Henricson | 162/30.1 |
| 5,374,333 A | * | 12/1994 | Nykanen et al. | 162/29 |

FOREIGN PATENT DOCUMENTS

| | | |
|---|---|---|
| CA | 1064206 | 10/1979 |
| SE | 6909674 | 9/1973 |
| WO | 9412720 | 6/1994 |

OTHER PUBLICATIONS

Ahlstrom Brochure, "New Generation Kraft Pulping and Bleaching Technology" 1992.*

Emerging Technologies Today and in the Future, Copyright 1992, pp. 1–6.

1981 Oxidative Bleaching, Denver Hilton, Denvr, Co., Oct. 22, Copyright 1981, pp. 75–78.

Optimized Hydrogen Peroxide Bleaching In Closed White–Water Systems, Rolf Anderson, et al pp. 111–115.

Bleaching A Softwood Kraft Pulp Without Chlorine Compounds, N. Liebergott, et al. pp. 323–332.

Mannbro, "Closed–cycle recovery and combustion of bleachery filtrate", Nordic Pulp and Paper Research Journal No. 3/1990, pp 134–141. No Trans.

* cited by examiner

*Primary Examiner*—Steve Alvo
(74) *Attorney, Agent, or Firm*—Jeffrey S. Melcher; Manelli, Denison & Selter, PLLC

(57) ABSTRACT

The present invention relates to a process for producing pulp which is cooked under alkaline conditions and which is bleached without using chlorine-containing bleaching chemicals, in which process used cooking chemicals are recovered in a first recovery installation and used bleaching chemicals are recovered in a second recovery installation. The used cooking and bleaching chemicals can be regenerated and reused.

18 Claims, 2 Drawing Sheets

TOTALLY CHLORINE FREE BLEACHING PROCESS USING RECOVERED FILTRATE

This is a continuation of application Ser. No. 08/160,257, filed on Dec. 2. 1993 now abandonded.

BACKGROUND OF THE INVENTION

1. Field of the Invention

The present invention relates to a process for producing pulp which is cooked under alkaline conditions and which is bleached without using chlorine-containing bleaching chemicals, with separate installations being used for recovering and for incinerating/gasifying filtrates from the cooking and the bleaching, respectively.

2. Description of Related Art

Bleaching pulp without using chlorine containing chemicals provides processing solutions which are of great interest from the environmental point of view. Thus, the discharge of impurities into the bleaching plant effluent can be reduced substantially and, in the optimum case, virtually eliminated by, in an appropriate manner, collecting up and concentrating the organic and inorganic compounds in the effluent and subsequently incinerating together the concentrates and the used chemicals from the cooking procedure. A process of this type has been reported in Swedish Patent Application no. 9201477-8.

Bleaching without chlorine-containing chemicals is carried out using hydrogen peroxide, sodium hydroxide and ozone, in particular. These bleaching chemicals are expensive, so that bleaching costs are significantly higher than in the case of conventional bleaching using chlorine and chlorine dioxide. It is therefore desirable, if possible, to be able to recover the bleaching chemicals, especially sodium hydroxide, separately. Sodium hydroxide is principally obtained in association with preparing chlorine gas by the electrolysis of sodium chloride. With decreasing use of chlorine gas, there is some risk of sodium hydroxide becoming an item in short supply.

The process, which is advantageous from the environmental point of view, of returning the used bleaching chemicals, and organic material released during the bleaching, to the system for recovering cooking chemicals can give rise to problems under certain circumstances. If the quantity of sodium compounds and sulphur-containing compounds in the bleaching plant effluent exceeds the requirement for "make-up" chemicals to cover losses, an imbalance arises in the Na/S ratio in the recovery cycle for cooking chemicals. This can lead to problems of having too high an emission of sulphur to the environment, and to other disturbances of the process as well. Another problem, which is equally serious, is that organic material in the bleaching plant effluent, which is incinerated in the works recovery boiler, leads to overloading of the boiler. A works recovery boiler is often utilized to maximum capacity. Overloading results in the production of pulp having to be decreased, which is an economic disadvantage. In those instances where transfer of used bleaching chemicals to the recovery cycle for cooking chemicals can lead to an imbalance in the Na/S ratio and/or overloading of an existing recovery boiler, a separate recovery cycle for the bleaching chemicals would be highly advantageous.

SUMMARY OF THE INVENTION

An object of the present invention is to provide a solution, which is technically and economically advantageous, both to the requirement for recovering bleaching chemicals separately and to the problems of limited capacity in the recovery boiler.

In the following, the term bleaching also embraces oxygen delignification.

The invention relates to a process for producing bleached pulp comprising the steps of cooking unbleached pulp under alkaline conditions with a cooking chemical to delignify said unbleached pulp, recovering a filtrate containing a used cooking chemical in a first recovery installation, bleaching said unbleached delignified pulp with a chlorine-free bleaching chemical, and recovering a filtrate containing a used chlorine-free bleaching chemical in a second recovery installation. Preferably, the used cooking and bleaching chemicals are regenerated and reused.

DETAILED DESCRIPTION OF PREFERRED EMBODIMENTS

The present invention will be explained with reference to FIGS. 1 and 2 which are non-limiting examples of a preferred embodiment.

Figure 1:
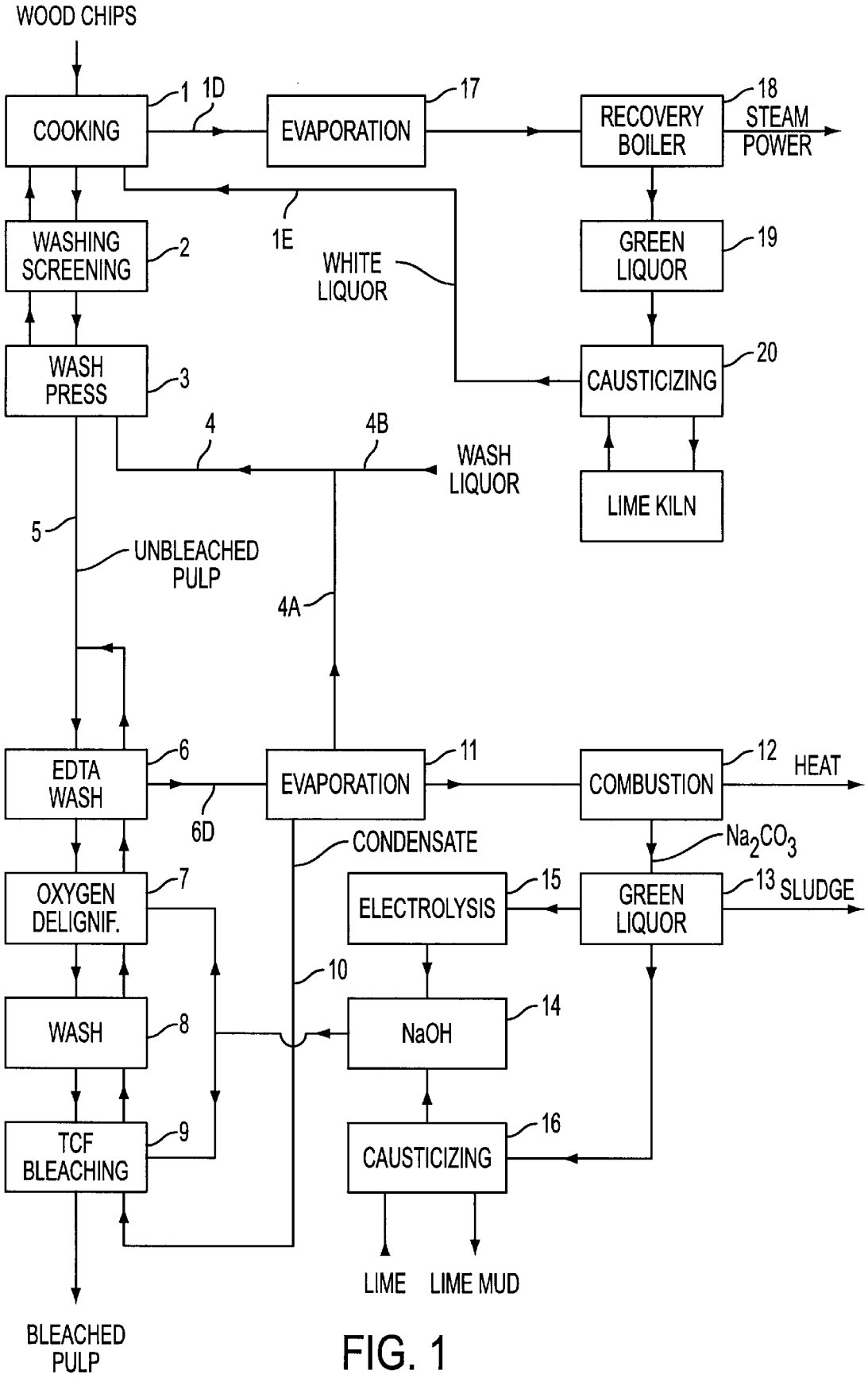
FIG. 1 shows a block diagram of a preferred embodiment.

FIG. 1 shows an embodiment of the invention in the form of a block diagram of a sulphate works in which the bleaching is totally chlorine-free (hereinafter "TCF").

Cellulosic material, such as wood chippings, is cooked in a digester house 1 which is equipped for modified sulphate cooking and which permits delignification to low kappa numbers, for example, below about 20, preferably below about 16, and more preferably below about 12. Subsequently, the pulp is washed and screened 2. After the screening 2, there follows a further washing stage 3.

Preferably, the final washing stage for unbleached pulp comprises a washing press 3, or another press, which permits dehydration to a high dry matter content, for example, about 20 to about 35%.

The washing liquid 4 for the final washing stage 3 comprises chemically purified water 4B and/or evaporation condensate 4A. The unbleached pulp 5 is thus thoroughly washed.

After the washing stage 3, and any intermediate storage, the pulp 5 is transferred to an acid wash stage 6, which includes the possible addition of a chelating agent, for example, ethylenediaminetetraacetic acid (hereinafter "EDTA"). The purpose of this stage is to remove heavy metals. Filtrate from a stage in the TCF bleaching plant 9 and/or recirculated filtrate from the acid wash stage 6 can be used for adjusting the consistency of the pulp. The washing liquid for the acid wash stage 6 comprises a filtrate from a subsequent oxygen-delignification stage 7 and/or TCF bleaching plant 9.

After the acid wash stage 6, there follows the oxygen-delignification stage 7. In the oxygen-delignification stage 7, delignification takes place to a low kappa number which, for soft wood, is lower than about 15, preferably lower than about 12, and for hard wood is lower than about 12, preferably lower than about 10. The treatment of the pulp with acid and with a chelating agent prior to the oxygen-delignification stage 7 removes heavy metal ions which otherwise impair selectivity during the oxygen delignification, such as by causing degradation of the cellulose. This wash thus permits the delignification to be taken further than is conventional, which is a major advantage for subsequent TCF bleaching.

After the oxygen-delignification stage 7, the pulp is washed in a washing system 8 possessing a high degree of washing efficacy, for example, higher than about 85%, preferably higher than about 90%.

After the oxygen-delignification stage 7 and washing stage 8, the pulp is conveyed to the TCF bleaching plant 9. The bleaching plant 9 can be designed with a number of different sequences, for example, one or more alkaline or acidic peroxide stages (P), peroxyacid stages, peroxide followed by ozone (PZ), peroxide, ozone and peroxide (PZP), or ozone, alkali extraction in the presence of oxygen Z(EOP)P and/or peroxide, and subsequently another peroxide stage.

Heavy metals, which are harmful for both the peroxide stage and the ozone stage, have been removed in the acid wash stage 6 prior to the oxygen-delignification stage 7. It is therefore not necessary to treat the pulp with chelating agent immediately prior to the peroxide stage, as must be done in conventional peroxide bleaching, for example in the Lignox process (SE-B-466061).

Washing liquid, preferably in the form of evaporation condensate 10, is supplied to one of the stages in the TCF bleaching plant 9. Except for the filtrate from the ozone stage, the filtrates from the different stages are conveyed in a countercurrent fashion to the pulp and drawn off via the wash after the acid wash stage 6. This filtrate 6D can contain organic material released from the pulp both in the oxygen-delignification stage 7 and in the TCF bleaching plant 9, and used bleaching chemicals, for example, sodium compounds arising from added sodium hydroxide and sulphur compounds, for example derived from sulphuric acid used for pH adjustment. In addition, the filtrate 6D can contain washing losses from the final washing stage for unbleached pulp in the form of organic material, sodium compounds, sulfides and relatively small quantities of heavy metals, which are derived originally from the wood and possibly being bound in complex form.

The filtrate 6D from the acid wash stage 6 is conveyed to an evaporation stage 11, where it is evaporated to a high dry matter content, for example, over about 40% DS. The evaporation 11 can be carried out in any conventional manner, for example, in a multi-step evaporation system with steam heating or by so-called mechanical steam compression, by combinations of mechanical steam compression and evaporation with steam, or by evaporation with the aid of low-grade waste heat in the form of hot water or another heat source. The condensate 4A, 10, which is obtained during the evaporation, can be utilized as a washing liquid in the TCF bleaching plant and/or for washing the unbleached pulp.

The concentrated filtrate containing organic material and sodium compounds, and possibly sulphur compounds as well, is conveyed to a separate incineration oven/gasification reactor 12, where the organic material is completely or partially oxidized and the sodium compounds are converted to sodium carbonate and, in the appropriate case, to sodium sulphate or sodium sulphide. The oxidation can either be carried out in the presence of an excess of oxygen or in the presence of a deficiency of oxygen, in which latter case the oxidation takes place under reducing conditions. The latter method, which is more preferably carried out in a CHEM-REC® (Kvaerner Pulping Technologies) reactor, involves gasification of the organic material to form a mixture of carbon monoxide, hydrogen gas and carbon dioxide. The incineration or gasification temperature must be sufficiently high to convert essentially all the carbon to gaseous products and sodium carbonate. Under reducing conditions, sodium sulfide is formed from the sulphur compounds which are supplied.

The sodium salts which are formed during incineration can be removed in the form of a smelt, which is dissolved in water and forms so-called green liquor 13. During gasification, an aqueous solution of these salts (green liquor) can be obtained by direct liquid cooling of the incineration gases, preferably in a so-called quench system. The incineration heat can be utilized for generating steam and/or preparing hot water. The combustible gases, principally hydrogen gas, carbon monoxide and methane, which are formed during the gasification represent a flexible energy source. The carbon monoxide gas which is formed can, by means of the so-called shift reaction, be used for generating further hydrogen gas. The crude hydrogen gas obtained in this way can be purified and used together with oxygen gas for the local preparation of hydrogen peroxide.

The green liquor 13 is filtered carefully in order to separate off precipitated substances which are contrary to the process, such as heavy metals and other impurities. The green liquor 13 can then utilized in whole or in part for preparing sodium hydroxide 14. This can be carried out either by electrolysis 15 or by so-called causticization 16. In the latter case, slaked lime is added, which reacts with the sodium carbonate to give sparingly soluble calcium carbonate and sodium hydroxide. The calcium carbonate (lime sludge) can be separated off by filtering and then conveyed to a lime kiln for reincineration.

Sodium hydroxide, obtained either by the electrolysis of green liquor or alternatively by causticization, can be used as a bleaching chemical in the oxygen-delignification stage 7 and/or for regulating the pH in a peroxide stage (P) or an alkali extraction stage (E) in the TCF bleaching plant 9. The system thus becomes to a large extent self-supporting with regard to sodium hydroxide, which is economically advantageous. In addition, the system is almost entirely closed, with the discharges of organic material and other impurities in the effluent water having been eliminated. oxygen, which can also be prepared within the works of the system, is required in addition to the above-mentioned chemicals.

The upper part of the block diagram in FIG. 1 shows how the spent liquor 1D (the filtrate from the cooking) is conveyed to an evaporation installation 17 in which the spent liquor is evaporated and subsequently incinerated in a recovery boiler 18. The heat which is produced in the recovery boiler is conserved in the form of steam having an energy content which is subsequently converted, for example, into electric power. In the recovery boiler 18, the inorganic products contained in the spent liquor form a smelt comprising, for example, sodium urbanite and sodium sulphide which are collected from the recovery boiler and dissolved in water to form green liquor 19. The green liquor is then converted in a causticization installation 20 such that a new cooking liquid, for example, a white liquor 1E ($NaOH+Na_2S$), is formed which is returned to the digester 1.

Sodium sulphate is obtained during the suprastoichiometric incineration of bleaching plant effluents which contain sulphur-containing compounds. The green liquor produced under these circumstances therefore contains both sodium carbonate and sodium sulphate. Causticization of the green liquor results in the formation of calcium sulphate, which is relatively soluble compared to the calcium carbonate (lime sludge). The sodium hydroxide solution therefore contains a relatively high content of sulphate ions. In addition, the lime consumption increases and the lime sludge contains a relatively high content of calcium sulphate, which can interfere with the course of the lime cycle. These difficulties can be avoided by using an organic acid, for example oxalic acid or acetic acid, for adjusting the pH in the acid bleaching stages. The organic acid can be incinerated in the boiler and does not interfere with the causticization reaction. Organic acids can also be used in systems which are based on the gasification of concentrates of bleaching plant effluents, and in this way the problems with sulphur can be eliminated completely.

When a green liquor containing both sodium carbonate and sodium sulphate is electrolyzed, sulphuric acid and sodium hydroxide are obtained. These chemicals can be separated by means of a suitable membrane and subsequently recirculated independently to the bleaching plant.

Sulphur compounds contained in the mother liquor give rise to sodium sulphide, rather than sodium sulphate, when partial incineration under reducing conditions, for example, gasification, takes place. However, an aqueous solution of sodium sulphide can be oxidized with oxygen, under pressure and at elevated temperature, to sodium sulphate, and the mixture with sodium carbonate subsequently subjected to electrolysis in accordance with the above description.

Any necessary "make-up" to compensate for losses of chemicals in the recovery cycle of the bleaching plant can be supplied, for example, in the form of fresh NaOH and sulphuric acid, $H_2SO_4$.

Chemical surpluses and any necessary regulation of the enriched concentration of substances which are contrary to the process and which derive originally from the wood can take place either by transferring a part of the green liquor or residual solution from the electrolysis to the system for recovering cooking chemicals and for regulating the pH of the effluent water. In the first-mentioned case, most of the impurities, for example heavy metals, are removed by way of the green liquor sludge which is obtained by filtering the green liquor, and then dealt with in a manner which is advantageous from the environmental point of view.

Figure 2:
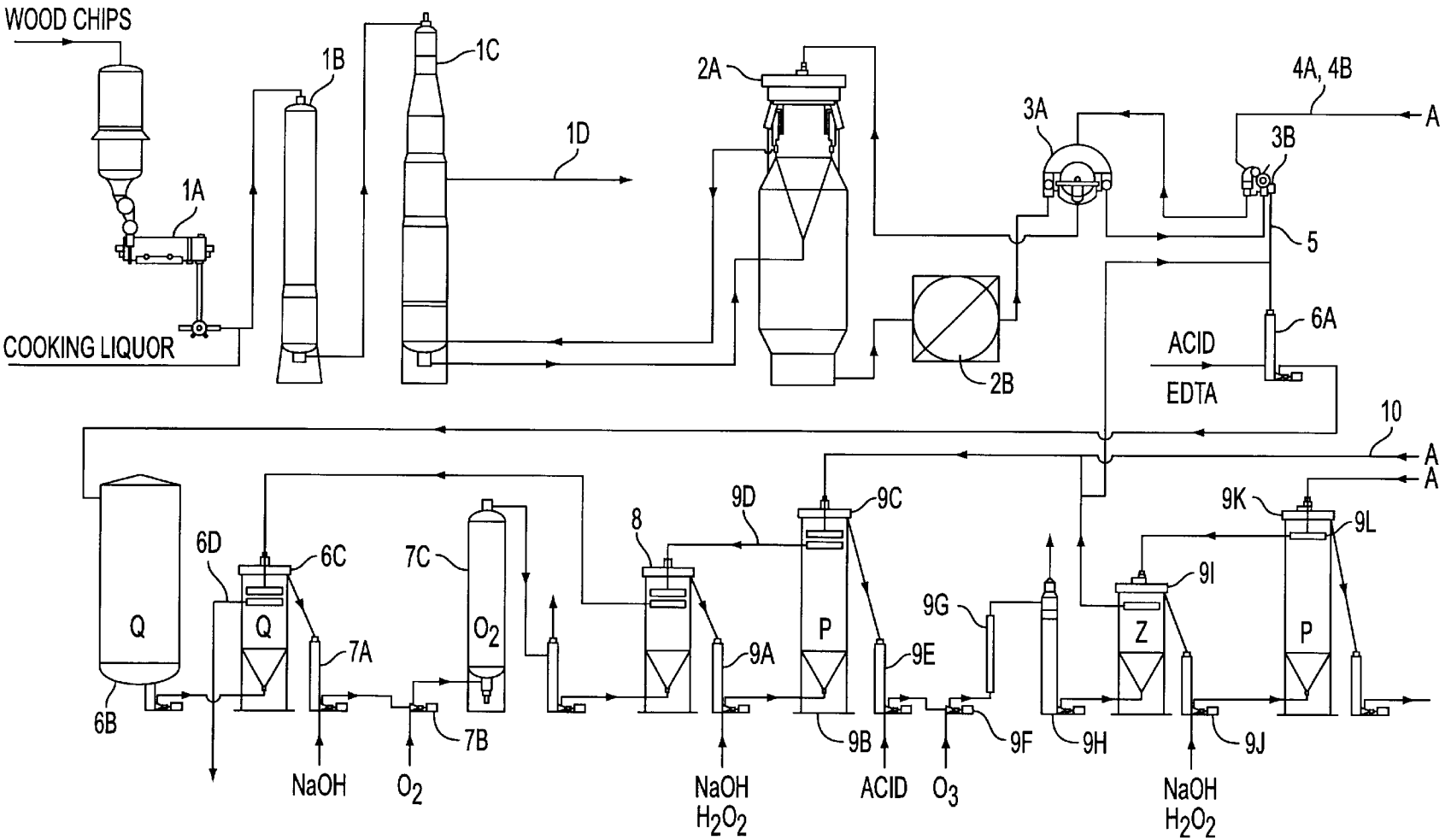
FIG. 2 shows an installation of a preferred embodiment.

FIG. 2 shows a preferred embodiment of the invention in the form of a system solution for the fiber line. Soft wood chippings are steamed 1A and preimpregnated 1B and then cooked in a KAMYR digester 1C equipped for modified sulphate cooking, which permits delignification to low kappa numbers, for example, about 18 to about 22, while preserving strength properties. The pulp, which has been partially washed in this process, is washed further firstly in a diffuser 2A and after screening 2B on a filter 3A which functions as a combined thickener and washing apparatus. Subsequently, the pulp is washed and thickened on a washing press 3B to a pulp consistency of about 25 to about 35%.

Chemically purified water 4B or evaporation condensate 4A is used as the washing liquid. The washing liquid is conveyed in countercurrent to the digester, where it moves upwards, again in countercurrent, to the withdrawal screen. A black liquor 1D is drawn off from the digester 1B and can be, for example, conducted to evaporation 17 and then to incineration in a recovery boiler 18, as shown FIG. 1.

The smelt from the boiler 18 is dissolved in water to form green liquor containing mainly sodium carbonate and sodium sulphide. The green liquor is subsequently causticized in a known manner to form a white liquor 1E containing mainly sodium hydroxide and sodium sulphide. The white liquor 1E is conveyed to the digester for decomposing the wood chippings.

The pulp leaves the washing press with a consistency of about 25 to about 35%. It is well washed and contains only about 3 kg of $Na^+$/ton of pulp and about 10 kg per ton of dissolved organic material. In addition, the pulp contains relatively small quantities of heavy metals.

The pulp from the washing press 3B is then diluted to a consistency of about 10% with filtrate, for example, in the proportion of about 6 tons filtrate/ton of pulp, from the ozone stage (Z) wash in the subsequent TCF bleaching plant 9. Using a KAMYR-MC pump 6A, acid, for example organic acid or sulphuric acid, is added together with a chelating agent such that a pH of about 5 to about 6 is achieved. The temperature in the EDTA stage 6B or Q stage should be about 50 to about 90° C. and the dwell time about 30 to about 60 minutes.

The pulp treated in this way is subsequently washed in a washing apparatus 6C (included in the so-called acid washing stage 6 ) possessing a high degree of washing efficacy, at least about 80%, preferably about 90 to about 95%, measured as its effect in separating off manganese. In the preferred case, a KAMYR two-stage diffuser 6C is employed. Other washing devices, for example a washing press or one or more washing filters in series, may be employed. During the washing, the pulp is freed from heavy metals, which are in the form of complexes in the filtrate 6D and which are conveyed to separate evaporation 11, (see FIG. 1) oxidation and chemical recovery. The filtrate 6D also contains most of the organic material which was released in the oxygen-delignification stage 7 and the TCF bleaching 9. In addition, most of the sodium compounds, and, where appropriate, the sulphur compounds which were added to the bleaching are in the filtrate 6D.

NaOH, at the rate of about 10 to about 20 kg per ton of pulp, and, if required to retain a high pulp viscosity, magnesium salt, are supplied in an MC pump 7*a* to the pulp, which is well washed and freed from heavy metals, and the pulp is then conveyed under pressure via an MC mixer 7B, in which oxygen and, if required to increase the temperature, steam are supplied, to a reactor 7C having a dwell time of about 30 to about 90 minutes, preferably of about 60 minutes. The temperature of the pulp is preferably about 80 to about 110° C. and the pressure about 3 to about 10 bar.

During the oxygen delignification, the kappa number is lowered to less than about 15, preferably less than about 12. The residual chemicals and released organic material are washed out after the oxygen stage in one or more washing devices 8 having a degree of washing efficacy of about 80 to about 95%, preferably about 90 to about 95%. FIG. 2 shows a KAMYR two-stage diffuser 8, but the washing can also be carried out using other devices having a similar degree of washing efficacy, for example filters or washing presses.

Hydrogen peroxide, at the rate of about 10 to about 35 kg of $H_2O_2$/ton of pulp, preferably about 20 to about 30 kg of $H_2O_2$ /ton of pulp, and sodium hydroxide, at the rate of about 5 to about 30 kg of NaOH/ton of pulp, preferably about 15 to about 25 kg of NaOH/ton of pulp, are subsequently supplied to the oxygen delignified pulp by means of an MC pump 9A and the pulp is then heated to a temperature of about 75 to about 95° C., preferably about 80 about 90° C. After that, the pulp is conveyed to one or more reaction towers having a dwell time of about 3 to about 8 hours, preferably about 4 to about 6 hours.

The peroxide-bleached pulp, having a brightness of about 75 to about 85 ISO, is washed in a washing apparatus 9C possessing a high degree of washing efficacy, for example, about 80 to about 95%, preferably about 90 to about 95%, for example, in a KAMYR two-stage diffuser. Either chemically purified water or evaporation condensate 10 can be used as the washing liquid. The temperature of the washing liquid is about 35 to about 55° C., preferably about 40 to about 50° C. The displaced peroxide-bleaching filtrate 9D is recirculated to the preceding washing apparatus 8, making it possible to utilize both residual peroxide and heat in the peroxide stage. After the peroxide bleaching stage 9B, the pulp is pumped onwards by means of a KAMYR MC pump 9E and is acidified to a pH of about 2 to about 6, preferably a pH of about 3 to about 4. Sulphuric acid, for example, or an organic acid, for example oxalic acid or acetic acid, is used for the acidification.

Ozone gas in oxygen, at a concentration of about 5 to about 15% A, is added at a pressure of about 5 to about 12 bar and mixed into the pulp suspension, which has a consistency of about 10%. One or more mixers of the KAMYR MC mixer 9F type, or another type of efficient mixing apparatus, is/are employed for the admixture. The temperature of the pulp suspension is about 35 to about 55° C., preferably about 40 to about 50° C. The charge of ozone gas should be about 2 to about 6 kg of $O_3$/ton of pulp, preferably about 3 to about 5 kg of $O_3$/ton of pulp.

After the admixture, the pulp suspension containing ozone gas is conveyed through a reactor 9G having a dwell time of about 1 to about 10 minutes, preferably about 1 to about 4 minutes. Subsequently, the pressure is lowered in a cyclone device 9H, with the gas being separated from the pulp suspension. The residual gas, which mainly comprises oxygen with small quantities of unrequited ozone, is cleaned of fiber in a scrubber (not shown) and conveyed to an ozone-destroying apparatus. The oxygen gas can be compressed in a compressor and reused in the oxygen-delignification stage, for example.

The pulp suspension, which has been freed of gas, is pumped to a washing stage 9I, for example a KAMYR one-stage diffuser. If appropriate, sodium hydroxide, for neutralizing to a pH of about 5 to about 10, and sulphur dioxide, for eliminating remaining ozone in the pulp suspension, are added before the wash. After the washing stage, alkali and hydrogen peroxide are supplied in a KAMYR MC pump and/or mixer 9J. The charge of peroxide should correspond to about 1 to about 5 kg Of $Hz_2O_2$ per ton of pulp and the charge of alkali should be sufficiently high to adjust the pH to a pH of about 10 to about 11. The temperature of the peroxide stage 9K is about 50 to about 80° C., preferably about 60 to about 75° C., and the dwell time of the pulp about 1 to about 4 hours, preferably about 2 to 5 about 3 hours.

After the peroxide stage 9K, the pulp is washed in a KAMYR one-stage diffuser 9L or other washing device having a similar degree of washing efficacy. At this stage, the brightness of the finally bleached pulp is about 85 to about 90 ISO, preferably about 88 to about 90 ISO.

If sulphuric acid is used in the acid wash stage 6 and the ozone stage 9B, the filtrate 6D, which is withdrawn from the acid wash stage (the Q stage), will have the following approximate composition per ton of pulp:

| | |
|---|---|
| Organic material | about 75 Kg |
| Na+ | about 30 kg |
| $SO_4$ | about 15 kg |
| Total dry matter | about 120 kg |

The quantity of liquid is about 10 $m_3$ per ton of pulp. This corresponds to a dry matter content of about 1.2%. The filtrate is evaporated to a dry matter content of about 50 to about 70%, with about 9 tons of condensate being obtained which can be used for washing the pulp after the first peroxide stage, or at another point in the process. The evaporated concentrate, which has a calorific value of about 9 MJ/kg of dry matter, is incinerated in an oxidizing environment, forming a smelt containing about 22 kg of $Na_2SO_4$ and about 52 kg of $Na_2Co_3$. The smelt is dissolved in water. The "green liquor" which is obtained is thoroughly filtered to separate off solid impurities, for example by precipitating out heavy metal salts. Subsequently, the solution is electrolyzed in electrolyzers having membranes which separate the sodium hydroxide and sulphuric acid which are formed. Based on the chemical content of the green liquor, about 13 kg of sulphuric acid and about 46 kg of NaOH are thus formed at an efficiency of about 90%. The necessary requirement for the oxygen-delignification stage and the TCF bleaching is about 15 kg of sulphuric acid per ton of pulp and about 50 kg of NaOH per ton of pulp. The requirement for fresh chemicals is therefore limited to about 2 kg of $H_2SO_4$ and about 4 kg of NaOH, in addition to peroxide and oxygen gas.

If an organic acid is used for acidification in the acid wash stage and ozone stage, only sodium carbonate is obtained in the smelt. After dissolution in water, the sodium carbonate solution can be treated with slaked lime, to form sodium hydroxide and calcium carbonate (lime sludge). The latter is washed and transferred to the lime kiln for re-incineration. The sodium hydroxide is used for bleaching.

If there is no economic motivation for recovering sodium hydroxide or sulphuric acid, the salts can be used for other purposes, for example as make-up chemicals in the cooking chemical cycle. In this case, the benefit is obtained that the recovery boiler for the cooking chemical cycle is not loaded with organic material released in the oxygen-delignification stage and/or in the TCF bleaching plant. In addition, discharge of organic material from the bleaching plant is eliminated.

Naturally, the invention can also be used in connection with the production of pulp from hard wood or other raw material, such as annual plants. The requirement for chemicals will vary depending on the degree of pulp brightness required and on the cellulose-containing raw material which is incorporated. The method can also be used in those cases where the cooking liquid is sulphur-free or has a low sulphur content and is mainly made up, for example, of an alkaline hydroxide. The method can advantageously be employed in those cases where the alkali metal base in the cooking and/or the oxygen delignification and TCF bleaching mainly comprises potassium instead of sodium.

It will be evident to one of ordinary skill in the art that the appurtenant incineration gasification/installation 12 can operate in accordance with essentially any of the currently known incineration/gasification principles, even if a CHEMREC® reactor is preferred. In addition, it will be evident that the recovery installation intended for the spent liquor can comprise a gasification reactor, for example a CHEMREC® reactor.

The invention is not limited to only two recovery boilers/reactors. Furthermore, it is possible to combine certain parts in the recovery cycle from the systems illustrated separately in FIG. 1. The degree of washing efficacy is defined as follows:

$$\frac{(X-Y)}{X} @ 100;$$

where X is the quantity of unwanted substance prior to washing and Y is the quantity of the substance remaining after washing, for a given quantity of pulp. The manganese content is advantageously employed as a reference value for the said substance.

The solitary "A" in FIG. 2 indicates the addition of chemically purified water or evaporation condensate.

While the invention has been described in detail, it is apparent to one of ordinary skill in the art that various modifications can be made without departing from the scope or spirit thereof.

What is claimed is:

1. A process for producing bleached pulp comprising the steps of:

cooking a cellulosic material under alkaline conditions with a cooking chemical to produce unbleached pulp;

recovering a filtrate containing a used cooking chemical in a first recovery installation;

washing said unbleached pulp with acid;

delignifying said unbleached pulp in the presence of oxygen, whereby a filtrate is produced containing released organic material;

bleaching said unbleached delignified pulp with a chlorine-free bleaching chemical;

recovering a filtrate containing a used chlorine-free bleaching chemical and said filtrate containing released organic material in a second recovery installation;

regenerating at least a portion of said used bleaching chemical; and supplying said regenerated bleaching chemical to at least one of said chlorine-free bleaching step or said oxygen delignification step.

2. The process for producing bleached pulp according to claim 1, further comprising the steps of regenerating at least a portion of said used cooking chemical; and reusing said regenerated cooking chemical in said cooking step.

3. The process for producing bleached pulp according to claim 2, wherein said first recovery installation further comprises the steps of:

evaporating said filtrate containing said used cooking chemical to produce a second concentrated filtrate;

incinerating said second concentrated filtrate to produce a second smelt comprising a metal salt;

dissolving said metal salt into an aqueous medium;

converting said metal salt to at least one of metal hydroxide and regenerated metal sulphide; and transferring at least one of said metal hydroxide and said metal sulphide to said cooking step, wherein at least one of metal hydroxide and metal sulphide used in said cooking step are regenerated and conserved.

4. The process according to claim 3, further comprising the steps of:

washing and screening said unbleached pulp;

washing and pressing said unbleached pulp;

adding at least one of water and an evaporation condensate to said unbleached pulp after pressing to adjust a consistency of said unbleached pulp;

transferring a filtrate from said washing and pressing step to said washing and screening step countercurrent to a direction of said unbleached pulp; and transferring a filtrate from said washing and pressing step to said cooking step countercurrent to said direction of said unbleached pulp.

5. The process according to claim 3, wherein said incineration step is conducted in an oxidizing environment under stoichiometric or suprastoichiometric conditions.

6. The process according to claim 3, wherein said metal salt comprises a sodium salt.

7. The process according to claim 3, further comprising the steps of electrolyzing said metal sulphide in said aqueous solution to produce sulphuric acid.

8. The process according to claim 7, further comprising the steps of oxidizing metal sulphide with oxygen to metal sulphade prior to said electrolysis.

9. The process for producing bleached pulp according to claim 1, wherein said second recovery installation comprises the steps of:

evaporating said filtrate containing said used bleaching chemical to produce a first condensate and a first condensed filtrate;

transferring said first condensate to at least one of said bleaching step and a washing press for washing and pressing said unbleached pulp;

incinerating said first condensed filtrate to oxidize organic matter and to form a first smelt comprising a metal salt;

dissolving said metal salt in an aqueous solvent;

converting said dissolved metal salt into regenerated metal hydroxide; and transferring said metal hydroxide to said bleaching step, wherein metal hydroxide used in said bleaching step is regenerated and conserved.

10. The process according to claim 9, said incineration step is conducted in a reducing environment to oxidize organic material contained in said pulp to a mixture comprising carbon monoxide, hydrogen gas and carbon dioxide.

11. Process according to claim 9, said bleaching step comprises the steps of:

acid washing said unbleached pulp with acid and optionally with a chelating agent to remove heavy metals from said unbleached pulp;

oxygen-delignifying said acid washed unbleached pulp; and bleaching said washed oxygen-delignified pulp with said chlorine free bleaching chemical.

12. The process according to claim 11, wherein said bleaching step further comprises the step of:

second washing said oxygen-delignified pulp at a washing efficacy of least 80%, wherein said regenerated metal hydroxide is used in at least one of said oxygen-delignification step and said chlorine free bleaching step.

13. The process according to claim 12, further comprising the steps of:

transferring a filtrate from said bleaching step of washed oxygen-delignified pulp to said second washing step countercurrent to a direction of said pulp;

transferring a filtrate from said second washing step to said oxygen-delignification step countercurrent to said direction of said pulp; and transferring a filtrate from said oxygen-delignification step to said acid washing step countercurrent to said direction of said pulp, wherein said filtrate containing said used bleaching chemical is from said acid washing step.

14. The process according to claim 11, wherein said metal salt is converted into said metal hydroxide by at least one of an electrolysis step and by a causticizing step.

15. The process according to claim 11, further comprising the steps of:

drawing off a filtrate from said acid washing step at a rate of at most 15 tons per ton of pulp, said filtrate comprising said used bleaching chemical; and evaporating said filtrate until a content of dry matter in said filtrate is concentrated to at least 50%, before incinerating said used bleaching chemical.

16. The process according to claim 11, wherein said metal salt comprises a sodium salt.

17. The process according to claim 11, further comprising the steps of supplying an organic acid to said acid washing step.

18. A process for producing bleached pulp comprising the steps of:

cooking a cellulosic material under alkaline conditions with a cooking chemical to produce unbleached pulp;

recovering a filtrate containing a used cooking chemical in a first recovery installation;

washing said unbleached pulp with acid, whereby an acid wash filtrate is produced;

delignifying said unbleached pulp in the presence of oxygen, whereby a filtrate is produced containing released organic material;

supplying said filtrate containing released organic material to said acid washing step countercurrent to a direction of said pulp;

bleaching said unbleached delignified pulp with a chlorine-free bleaching chemical, whereby a filtrate is produced containing a used chlorine-free bleaching chemical;

supplying said filtrate containing a used chlorine-free bleaching chemical to said oxygen delignification step countercurrent to said direction of said pulp;

recovering said acid wash filtrate in a second recovery installation;

regenerating at least a portion of said used bleaching chemical present in said acid wash filtrate; and supplying said regenerated bleaching chemical to at least one of said chlorine-free bleaching step or said oxygen delignification step.

* * * * *

UNITED STATES PATENT AND TRADEMARK OFFICE

CERTIFICATE OF CORRECTION

PATENT NO. : 6,336,994 B1
DATED : January 8, 2002
INVENTOR(S) : Backlund et al.

It is certified that error appears in the above-identified patent and that said Letters Patent is hereby corrected as shown below:

Title page,
Item [*.] Notice:, delete "0" and replace with -- 1679 --

Signed and Sealed this

Twenty-sixth Day of November, 2002

*Attest:*

*Attesting Officer*

JAMES E. ROGAN
*Director of the United States Patent and Trademark Office*